United States Patent [19]

Zunkel et al.

[11] Patent Number: 4,883,123

[45] Date of Patent: Nov. 28, 1989

[54] ABOVE PACKER PERFORATE, TEST AND SAMPLE TOOL AND METHOD OF USE

[75] Inventors: Gary D. Zunkel, Chickasha; H. Kent Beck, Duncan, both of Okla.; Jon B. Christensen, Ankeny, Iowa

[73] Assignee: Halliburton Company, Duncan, Okla.

[21] Appl. No.: 276,491

[22] Filed: Nov. 23, 1988

[51] Int. Cl.[4] ..... E21B 49/08

[52] U.S. Cl. ..... 166/264; 166/297; 166/332; 175/59

[58] Field of Search ..... 166/167, 168, 169, 55, 166/228, 332, 336, 250, 264, 297, 131, 184, 185; 175/50, 58, 59

[56] References Cited

U.S. PATENT DOCUMENTS

| | | | |
|---|---|---|---|
| 2,169,559 | 8/1939 | Halliburton | 166/1 |
| 2,681,110 | 6/1954 | Harrison | 166/55 |
| 2,740,479 | 4/1956 | Schwegman | 166/145 |
| 2,947,361 | 8/1960 | Hyde | 166/100 |
| 2,982,130 | 5/1961 | McMahan | 73/155 |
| 3,103,811 | 9/1963 | Ayres et al. | 73/152 |
| 3,189,094 | 6/1965 | Hyde | 166/55.1 |
| 3,253,654 | 5/1966 | Briggs, Jr. et al. | 166/100 |
| 3,254,531 | 6/1966 | Briggs, Jr. | 73/155 |
| 3,273,647 | 9/1966 | Briggs, Jr. et al. | 166/100 |
| 3,273,659 | 9/1966 | Reynolds, Jr. | 175/4 |
| 3,456,726 | 7/1969 | Barrington et al. | 166/162 |
| 3,610,335 | 10/1971 | Smith | 166/55.1 |
| 3,664,415 | 5/1972 | Wray et al. | 166/0.5 |
| 3,964,305 | 6/1976 | Wray et al. | 73/151 |
| 3,969,937 | 7/1976 | Barrington et al. | 73/151 |
| 4,063,593 | 12/1977 | Jessup | 166/317 |
| 4,426,882 | 1/1984 | Skinner | 73/155 |
| 4,484,632 | 11/1984 | Vann | 166/297 |
| 4,614,156 | 9/1986 | Colle, Jr. et al. | 102/312 |
| 4,633,952 | 1/1987 | Ringgeberg | 166/336 |
| 4,655,298 | 4/1987 | George et al. | 175/4.52 |
| 4,657,082 | 4/1987 | Ringgenberg | 166/336 |

OTHER PUBLICATIONS

Hallibutron Services Sales and Service Catalog No. 43, p. 2548.

U.S. patent application Ser. No. 040,219 filed Apr. 20, 1987, on behalf of David S. Wesson, Michael E. McMahan and Flint R. George.

U.S. patent application Ser. No. 064,285 filed Jun. 19, 1987, to Christensen.

Engineered Well Completion Product Catalog published by Vann Systems, pp. B-5-B-8.

GEO Vann Engineered Well Completions Catalog, p. B-22.

Halliburton Services Sales and Service Catalog No. 43, pp. 2533-2534.

*Primary Examiner*—Stephen J. Novosad

*Assistant Examiner*—Terry Lee Melius

*Attorney, Agent, or Firm*—James R. Duzan; Neal R. Kennedy

[57] ABSTRACT

An above packer perforate, test and sample tool for use in obtaining a sample of fluid from a formation reservoir in a well. The apparatus includes a sampler and an actuator cylinder positioned above a packer and a valve body below the packer. An operating mandrel opens a valve below the packer to flow the fluid from a well annulus defined below the packer to a sampling chamber in the sampler above the packer. The operating mandrel is moved in response to a pressure differential between the pressure in the well annulus above the packer and a pressure in the tool. In another embodiment, a second packer may be positioned below the first packer to sealingly engage the well bore below the well formation. A method of sampling fluid from a well formation is also disclosed.

19 Claims, 4 Drawing Sheets

ABOVE PACKER PERFORATE, TEST AND SAMPLE TOOL AND METHOD OF USE

BACKGROUND OF THE INVENTION

1. Field of the Invention

This invention relates to tools used to sample fluids from a formation reservoir in a well, and more particularly, to a perforate, test and sample tool attached to the end of a tool string and having perforating guns, one or two packers, and a sampler above the packers adapted for entrapping a fluid sample without flowing well fluids into the tool string.

2. Description of the Prior Art

It is frequently necessary to obtain information about well fluid in a well formation reservoir prior to actually producing the well. Measuring the pressure and temperatures of the fluid is important, but it is also desirable to obtain an actual sample of the fluid and bring that sample to the surface so that the physical characteristics of the fluid may be observed. As a result, numerous testing and sampling apparatus have been developed.

One such formation tester is disclosed in U.S. Pat. No. 2,169,559 to Halliburton, assigned to the assignee of the present invention. This apparatus includes a packer with perforating guns positioned therebelow and having a valve therein such that after the packer is set and the guns triggered, fluid from the well formation reservoir flows through the valve into a cylindrical body at the lower end of the tool string. The valve is reclosed such that a volume of fluid is contained in the lower portion of the tool string. The tool string may be removed from the well bore and the sample drained for testing.

One problem with this apparatus and other sampling apparatus previously known is that hydrocarbons from the well formation are actually flowed into the tool string or to the surface. Because the formation is at a relatively high pressure, there is always the danger of a blowout of the well. Also, if sour gas is present in the sample fluid, special equipment is necessary on the surface and downhole for handling it.

One device which solves these problems by providing a tool with a totally enclosed sampling chamber is disclosed in U.S. patent application Ser. No. 064,285 to Christensen, assigned to the assignee of the present invention, and incorporated herein by reference. In this tool, the sampling chamber is configured such that the hydrocarbons from the well formation reservoir are never flowed into the tool string, and because the fluid sample is totally enclosed, the sampler may be handled at the surface. A minimum of special equipment is needed for handling the fluids in the sampler even if the sample fluid contains sour gas.

This previous apparatus using an enclosed sampling chamber has length limitations in the sampling chamber because it is positioned below the packer. The present invention is a variation on this previous device in which the sampling chamber is positioned above the packer or packers.

Other samplers adapted for obtaining a self-contained sample have been used on wirelines. In such apparatus, the tool is lowered on a wireline and perforating guns triggered and the sample chamber filled. Because the device is on a wireline, it is not possible for a large fluid sample to be obtained. The present invention which is lowered on a tool string obviously has no such weight limitations. Also, wireline sampling devices are not totally reliable and frequently the sample obtained is less than desirable.

SUMMARY OF THE INVENTION

The above packer perforate, test and sample tool of the present invention is a downhole tool for use in a well bore and comprises housing means for attaching to a tool string, packer means for sealingly engaging the well bore such that a well annulus portion is defined above and below the packer means, sampler means disposed above the packer means for receiving a well fluid sample, an activator means for providing fluid communication between the sampler means and the well annulus portion below the packer means. The tool preferably further comprises passageway means in the housing means for communicating between the sampler means and a portion of the housing means below the packer means.

The activator means is preferably movable in response to a pressure in the well annulus portion above the packer means. In this way, the activator means is movable from a first closed position to an open position and from the open position to a second closed position. Shearing means are provided for shearably holding the activator means in the first closed position. Preferably, locking means are provided for locking the activator means in the second closed position.

In one embodiment, the packer means is a first packer means, and the tool further comprises a second packer means for sealingly engaging the well bore below the first packer means. In this embodiment, the activator means provides communication between the sampler means and the well annulus portion defined between the first and second packer means.

Stated in another way, the present invention is a downhole tool for testing fluid from a formation reservoir in a well and comprises a packer sealingly engageable with a well bore such that a first well annulus portion is defined above the packer and a second well annulus portion is defined therebelow, a housing portion disposed above the packer and defining a sampling chamber therein, a valve disposed below the packer and having a valve port therein in communication with a second well annulus portion, passageway means for providing communication between the sample chamber and the valve, and an operating mandrel slidably disposed in the housing portion, packer and valve for providing fluid communication between the sampling chamber and the port in the valve when in an open position. The housing means preferably defines an actuator port therein in communication with the first annulus portion, and the operating mandrel is movable in response to a pressure differential between the first well annulus portion and a pressure in the tool. The operating mandrel comprises an area thereon against which a differential pressure between a central opening of the mandrel and the first well portion acts. A drain means is provided for draining the sampling chamber when the tool is removed from the well bore.

Again, in one embodiment, the packer is an upper packer, and the tool further comprises a lower packer spaced below the upper packer and sealing a lower end of the second well annulus portion below the first packer. The valve port is located between the packers in this embodiment.

The passageway means preferably comprises a generally longitudinal passageway defined in the housing portion and extending around the area against which the pressure acts on the operating mandrel.

The invention also comprises a method of sampling fluid from a well formation comprising the steps of positioning tool on a tool string in a well bore, setting a packer in the tool in the well bore such that well annulus portions are defined above and below the packer, actuating a perforating gun below the packer to perforate the formation, opening a sampler valve below the packer by lowering pressure in the well annulus portion above the packer to a level below a pressure in the tool, filling a sampling chamber above the packer with a predetermined volume of formation fluid from the well annulus portion below the packer, and closing the sampler valve by raising pressure in the well annulus above the packer to a level above a pressure in the tool. The steps of opening and closing the sampler valve may comprise actuating an operating mandrel which extends above and below the packer in the tool.

When a second packer is used, the method further comprises the step of setting the second packer below the first mentioned packer such that the well annulus portion below the first packer is sealed at a location below the well formation.

After the sample has been taken, the method further comprises the steps of unsetting the packer or packers, removing the tool string from the well bore, and draining fluid from the sampling chamber at the surface.

An important object of the invention is providing perforate, test and sample tool for obtaining a fluid sample from a well formation without flowing well fluids into the tool string.

Another object of the invention is to provide a tool for flowing a well formation fluid sample into a sample chamber positioned above a packer or packers in the tool string.

A further object of the invention is to provide a perforate, test and sample tool having a sampler valve below the packer which is opened in response to a differential pressure between an internal pressure in the tool and a well annulus pressure above the packer.

Another object of the invention is to provide a method of obtaining a well fluid sample by flowing well fluid into a self-contained sample chamber above a packer or packers in a tool string.

Additional objects and advantages of the invention will become apparent as the following detailed description of the preferred embodiment is read in conjunction with the drawings which illustrate such preferred embodiment.

DETAILED DESCRIPTION OF THE PREFERRED EMBODIMENTS

Figure 1A:
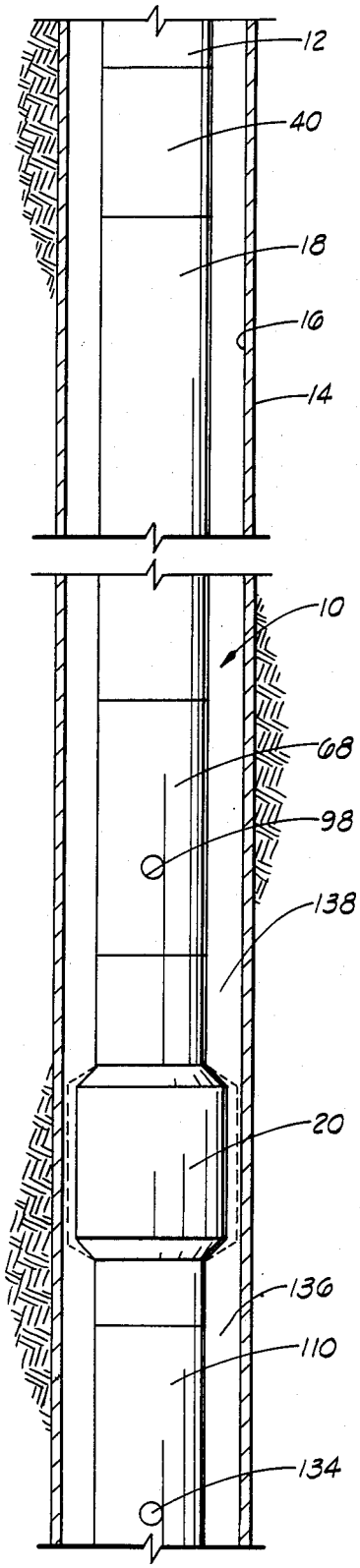
FIGS. 1A and 1B show one embodiment of the perforate, test and sample tool of the present invention, in which one packer is used, in position in a well bore.
Figure 1B:
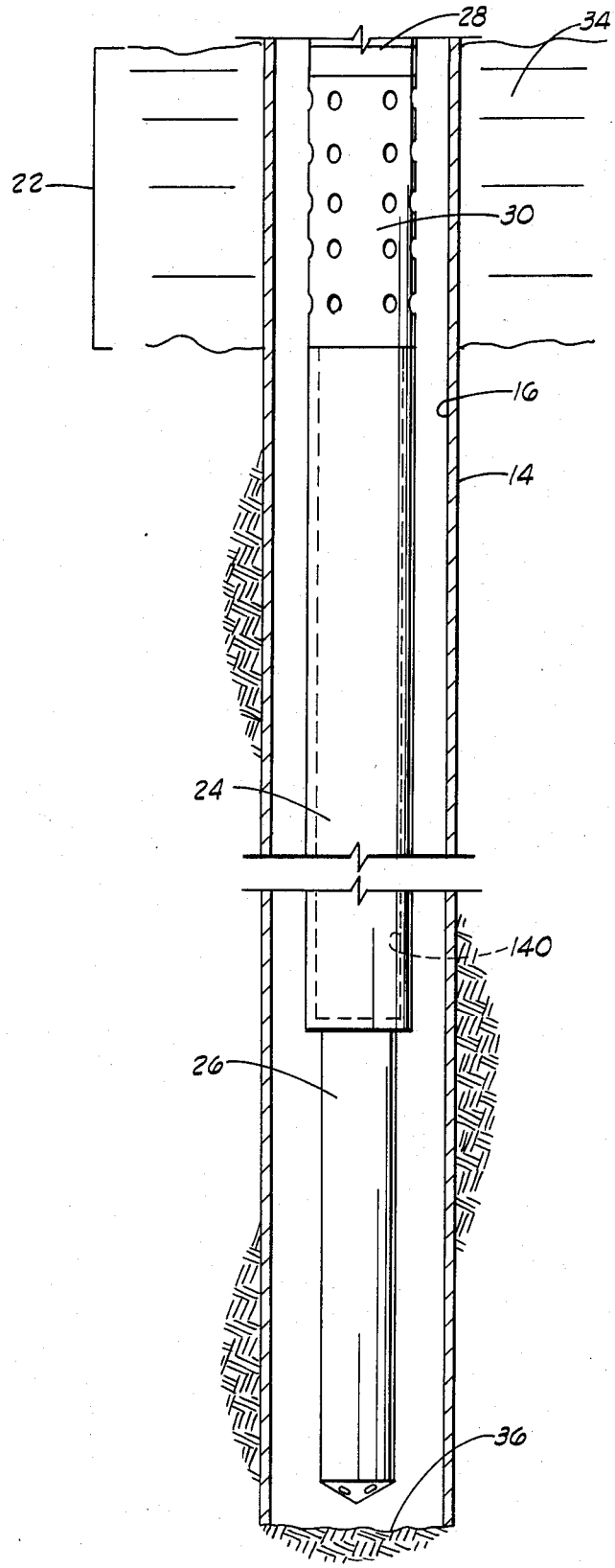

Referring now to the drawings, and more particularly to FIGS. 1A and 1B, a first embodiment of the perforate, test and sample tool of the present invention is shown and generally designated by the numeral 10. Tool 10 is at the lower end of a tool string 12 and is positioned in a well casing 14 defining a well bore 16.

The major components of tool 10 include a sampler 18, a packer 20, live perforating guns 22, blank guns or junk chamber 24 and a bundle gauge carrier 26 of a kind known in the art. Tool string 12 may contain other necessary components (not shown) as necessary.

As indicated, packer 20 is of a kind known in the art, such as the Halliburton Champ® III retrievable packer, manufactured by the assignee of the present invention. This packer is set by rotating tool string 12 and setting down weight. The packer is released by an upward pull.

Live guns 24 are also of a kind known in the art such as used in the Vanngun, manufactured by Vann Engineered Well Completions, a subsidiary of the assignee of the present invention. Live guns 24 include a firing head 28 such as the GEO® Vann firing head, and gun portion 30.

Figure 2A:
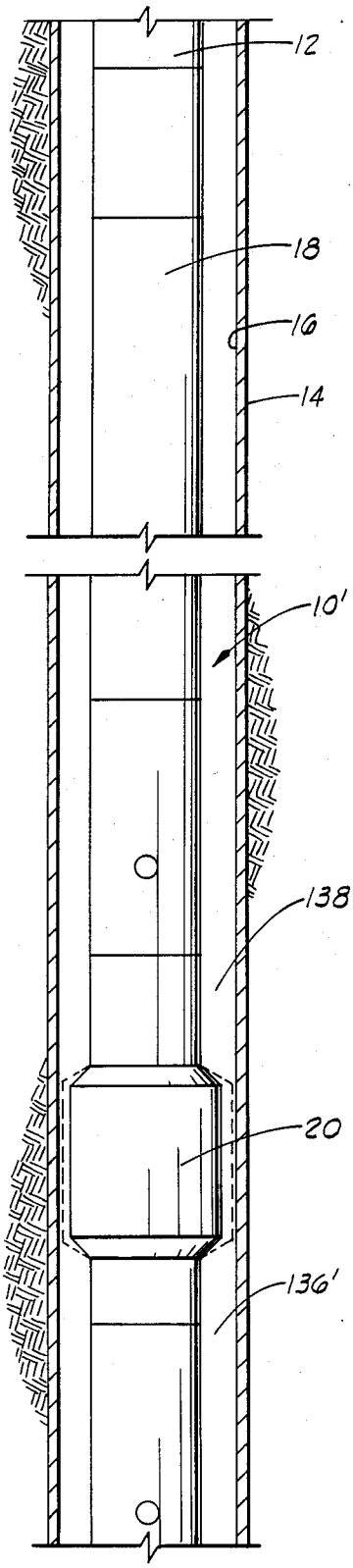
FIGS. 2A and 2B illustrate another embodiment of the perforate, test and tool of the present invention, using two packers above and below a well formation, in position in the well bore.
Figure 2B:
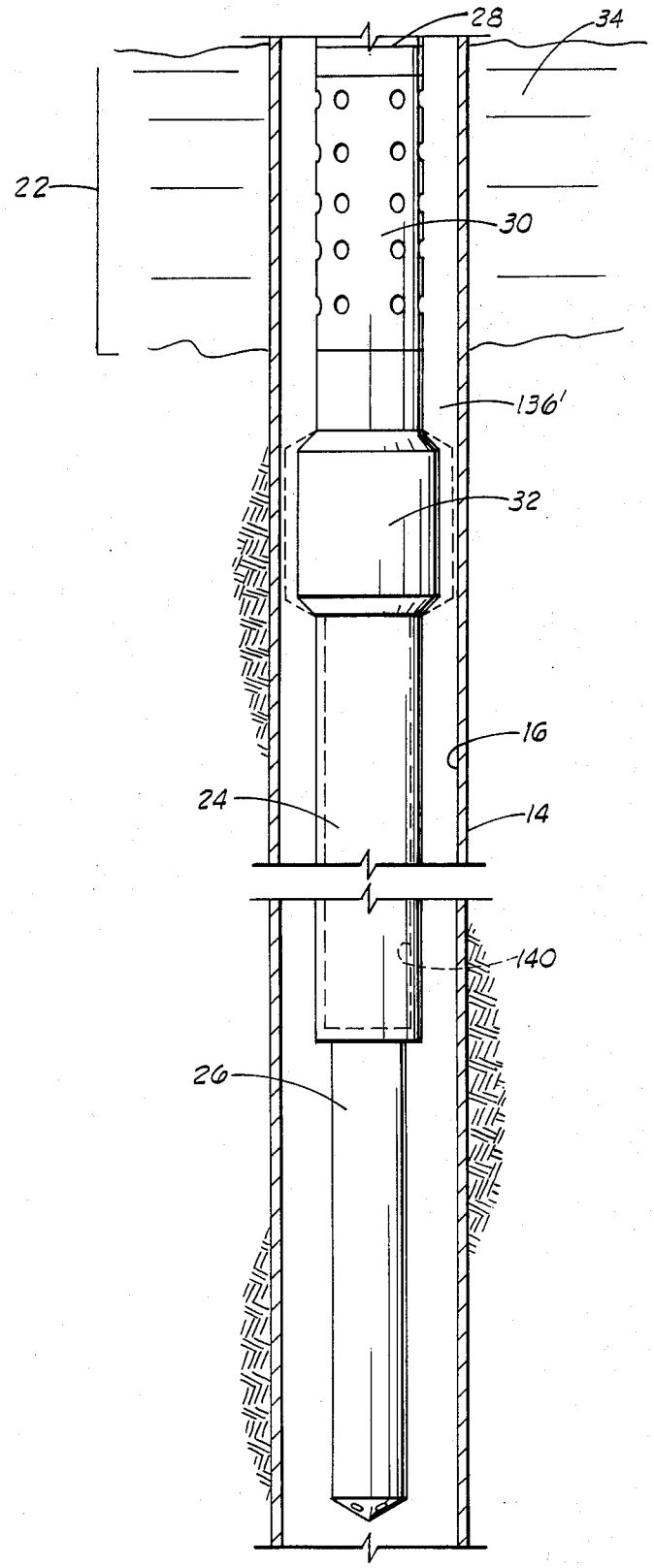

Referring now to FIGS. 2A and 2B, a second embodiment 10' of the perforate, test and sample tool of the present invention is shown. Second embodiment 10' is essentially the same as first embodiment 10, except that the second embodiment also includes a second, lower packer 32 positioned between live guns 22 and blank guns 24.

With either embodiment, tool string 12 is positioned so that guns 22 are substantially adjacent to well formation 34 to be tested. Packer 20 is thus above well formation 34 in both embodiments, and in second embodiment 10', packer 32 is below well formation 34. It will be seen by those skilled in the art that first embodiment tool 10 is adapted for use in a well bore generally adjacent to bottom 36 thereof or may be used in any well bore that does not have a flowing formation below formation 34. Second embodiment tool 10' may be used in situations where there is a necessity to seal below well formation 34, such as when there is another well formation downhole therefrom.

Figure 3A:
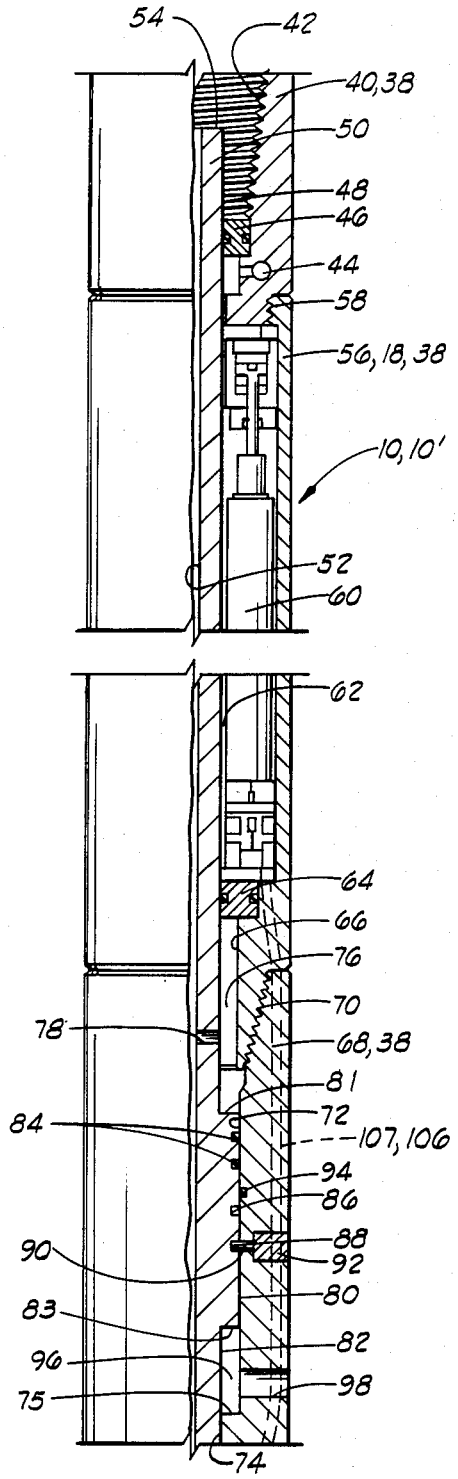
FIGS. 3B and 3B show a general partial cross section and partial elevation of an embodiment of the perforate, test and sample tool of the present invention showing the components in position as the tool is run into the well bore.
Figure 3B:
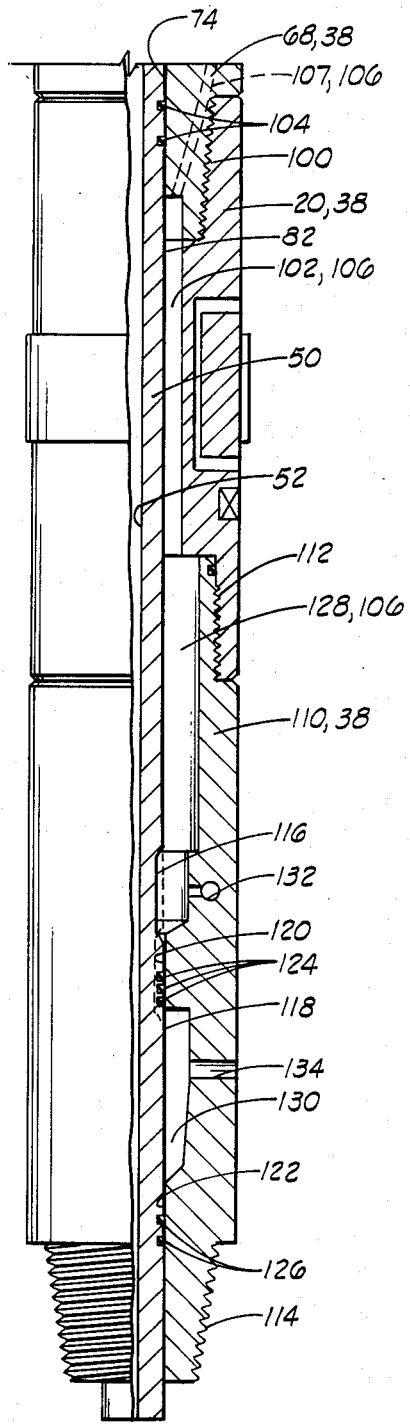

Referring now to FIGS. 3A and 3B, one embodiment of the invention is shown in more detail. However, it should be understood that the invention is not intended to be limited to the specific embodiment shown.

Tool 10, 10' comprises an outer housing means 38, and the uppermost component of the housing means is a drain sub 40 having a threaded bore 42 adapted for connection to tool string 12. Drain sub 40 includes a drain means, such as drain passageway 44, which can be opened at the surface to drain the fluid sample from tool 10.

Above drain passageway 44 a sealing means 46 is disposed in drain sub 40 for providing sealing engagement between the drain sub and first outside diameter 48 of an activator or operating mandrel means 50. Activator mandrel means 50 defines a longitudinally extending central opening 52 therethrough. Activator mandrel means 50 has an upper end 54 which is positioned above sealing means 46, and it will thus be seen that central opening 52 is in communication with a central opening through tool string 12.

The lower end of drain sub 40 is connected to sampler body 56 of sampler 18 at threaded connection 58. It will be seen that sampler body 56 forms a portion of housing means 38.

Sampler 18 is of a kind similar to that shown in previously mentioned U.S. patent application Ser. No. 064,285 to Christensen and may include a plurality of individual elongated sampler modules 60 positioned in an elongated sampling chamber 62.

It will be seen that activator mandrel means 50 extends downwardly through sampler 18 in sampling chamber 62, and a lower sealing means 64 provides sealing engagement between sampler body 56 and another portion of first outside diameter 48 of activator mandrel means 50. The lower end of sampler body 56 defines a bore 66 extending below lower sealing means 64. Also, the lower end of sampler body 56 is connected to an activator cylinder or body 68 at threaded connection 70. Activator cylinder 68 is part of housing means 38 and defines a first bore 72 therethrough and a second bore 74 which is smaller than first bore 72. A generally annular volume 76 is thus defined between first outside diameter 48 of activator mandrel means 50 and bore 66 of sampler body 56 and first bore 72 of activator cylinder 68.

Activator mandrel means 50 defines at least one substantially transverse port 78 therethrough which provides communication between central opening 52 of the activator mandrel means and annular volume 76. Below ports 78, activator mandrel means 50 has a second outside diameter 80 in close, spaced relationship to first bore 72 and activator cylinder 68. An upwardly facing, substantially annular shoulder 81 is thus formed on activator mandrel means 50 extending between first outside diameter 48 and second outside diameter 80 thereof. Activator mandrel means 50 also has a third outside diameter 82, which is smaller than second outside diameter 80, such that a downwardly facing substantially annular shoulder 83 is formed on the activator mandrel means. Annular shoulders 81 and 83 have substantially the same area in the embodiment shown in FIGS. 3A and 3B. These shoulders 81 and 83 comprise an actuator portion of activator mandrel means 50, as will be further discussed herein.

Sealing means, such as piston rings 84, provide sealing engagement between activator cylinder 68 and second outside diameter 80 of activator mandrel means 50. As will be further described herein, piston rings 84 provide a sliding sealing engagement as activator mandrel means 50 is longitudinally moved within housing means 38.

A locking groove 86 and a shear pin groove 88 are defined in second outside diameter of activator mandrel means 50. In the initial position shown in FIGS. 3A and 3B, shear pins 90 engage activator cylinder 68 and shear pin groove 88. Shear pins 90 are held in place by any conventional means, such as plugs 92. A locking dog assembly 94, 5 of a kind known in the art, is disposed in activator cylinder 68. In this initial closed position, as further described herein, it will be seen that locking groove 86 is below locking dogs 94.

Below second outside diameter 80 of activator mandrel means 50, another annular volume 96 is defined between third outside diameter 82 of activator mandrel means 50 and first bore 72 of activator cylinder 68. A plurality of substantially transverse ports 98 are defined in activator cylinder 68 and provide communication between annular volume 96 and the well annulus adjacent to activator cylinder 68.

Referring now to FIG. 3B, the lower end of activator cylinder 68 is connected to packer 20 at threaded connection 100. Packer 20 is configured such that an annular volume 102 is defined adjacent to and along third outside diameter 82 of activator mandrel means 50 below second bore 74 in activator cylinder 68.

A sealing means, such as piston rings 104, provide sealing engagement between third outside diameter 82 of activator mandrel means 50 and second bore 74 of activator cylinder 68. Thus, annular volume 96 (see FIG. 3A) is sealingly separated from annular volume 102. Referring to both FIGS. 3A and 3B, a sampling passageway means 106 extends longitudinally through housing means 38 so that fluid communication is provided between annular volume 102 and the lower end of sampling chamber 62. In the embodiment shown, sampling passageway means 106 comprises annular volume 102 and a longitudinally extending passageway 107 in housing means 38.

Referring again to FIG. 3B, the lower end of packer 20 is attached to a valve body 110, which is also a component of housing means 38, at threaded connection 112. The lower end of valve body 110 has a threaded surface 114 adapted for connection to components therebelow.

Activator mandrel means 50 extends downwardly through valve body 110 and provides a valve therein. Activator mandrel means 50 has a fourth outside diameter 116 which is somewhat smaller than third outside diameter 82 thereof, and a fifth outside diameter 118 which is larger than fourth outside diameter 116. Fifth outside diameter 118 is adapted for close, spaced relationship to aligned bores 120 and 122 in valve body 110. In the position shown in FIG. 3B, an upper sealing means 124 provides sealing engagement between fifth outside diameter 118 of activator mandrel means 50 and bore 120 in valve body 110. In other words, the valve is closed. Similarly, a lower sealing means 126 provides sealing engagement between fifth outside diameter 118 of activator mandrel means 50 and bore 122 in valve body 110. Thus, upper and lower annular chambers 128 and 130 are formed in valve body 110 above and below bore 120 in the valve body, respectively. Annular chamber 128 will be seen to form a portion of passageway means 106.

Another drain means, such as drain passageway 132, is provided for draining annular chamber 128 at the surface as necessary. At least one substantially transverse valve port 134 is defined in valve body 110 to provide communication between annular chamber 130 and the well annulus adjacent to the valve body. Of course, annular chamber 128 is in communication with annular volume 102.

OPERATION OF THE INVENTION

As already indicated, the components of tool 10, 10' are in the configuration shown in FIGS. 3A and 3B when the tool is run into well bore 16 at the end of tool string 12. Once tool 10, 10' is positioned in the well bore 16 at the desired location, as illustrated in FIGS. 1A and 1B for tool 10 and FIGS. 2A and 2B for tool 10', upper packer 20 and lower packer 38, if any, are actuated such that the packer elements are sealingly engaged with well bore 16 as shown by phantom lines in FIGS. 1A, 2A and 2B. Firing head 28 is then triggered, and gun portion 30 of live guns 22 fire to perforate casing 14 adjacent to formation 34 so that well fluids will flow from the formation. For the Vann gun previously mentioned, firing head 28 is triggered by pressurizing the well annulus and the internal portion, including central passageway 52, of tool 10.

For tool 10 with one packer 20, a sealed well annulus 136 is defined around the portions of tool 10 below packer 20, and another well annulus 138 is defined around the portions of the tool above packer 20. Similarly, for tool 10', a well annulus 136' is defined between packers 20 and 32, and a well annulus 138 is defined above packer 20. With either configuration, when live guns 22 are fired, fluid enters blank guns or junk chamber 24 such that inner cavity 140 therein is filled with fluid, well debris and mud filtration of the reservoir. The majority of the debris resulting from perforation of well bore 16 and the mud filtration will either fall to the bottom of annulus 136 or 136' or go into cavity 140 rather than enter sampler 18 once the sampler is subsequently opened. Thus, a clean-up means is provided for cleaning well annulus 136 or 136' below packer 20 prior to flowing to sampler 18.

When it is desired to take the fluid sample, pressure in well annulus 138 is lowered below the internal pressure in tool 10. That is, the pressure in ports 98 and annular volume 96 are lowered below the pressure in central opening 52, port 78 and annular volume 76. This pressure differential acts downwardly on shoulder 81 on activator mandrel means 50 which is sufficient to force activator mandrel means 50 downwardly such that shear pins 90 are sheared. Referring to FIG. 3B, activator mandrel means 50 is moved downwardly such that fourth outside diameter thereof is substantially aligned with bore 120 in valve body 110, as indicated by the dashed lines. That is, sealing means 124 is moved below bore 120, and the valve is opened. In this position, annular chambers 120 and 128 are thus placed in communication. It will be seen by those skilled in the art that this places ports 134 in communication with sampling chamber 62 in sampler 18 by the flow path formed by annular chambers 128 and 130, annular volume 102, and passageway 107. Activator mandrel means 50 is thus in an open position so that a sample of fluid from formation 30 flowing into well annulus 136 or 136' may be received in sampler 18 for later testing. The details of the operation of sampler 18 are further described in U.S. patent application Ser. No. 064,285, already incorporated herein by reference.

Figure 4A:
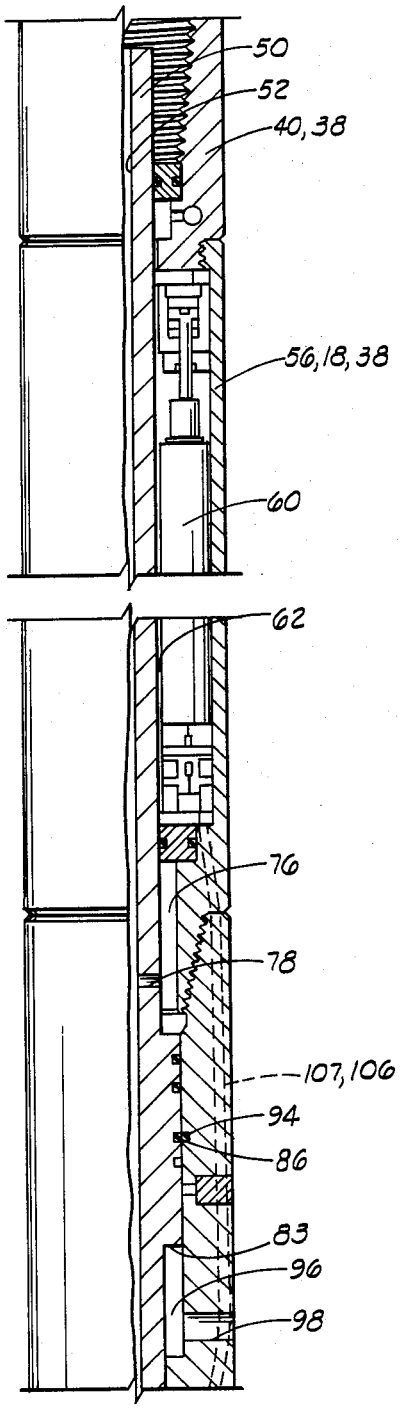
FIGS. 4A and 4B show the tool after the sample valve has been opened, reclosed and locked in the second closed position.
Figure 4B:
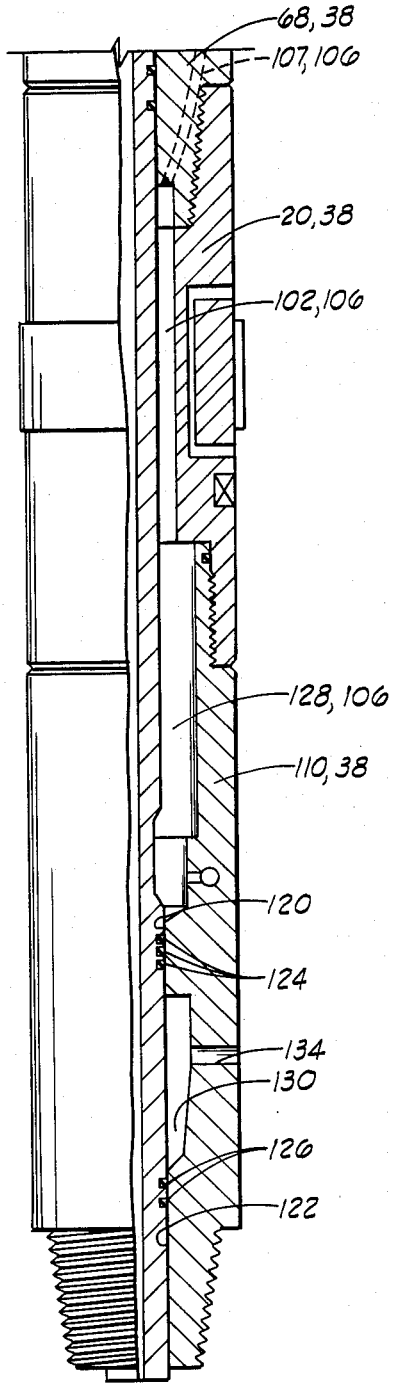

Once the desired sample has been taken, the pressure in well annulus 138 is raised above that in tool 10 or 10' so that an upwardly acting force is applied on shoulder 83 on activator mandrel means 50. The activator mandrel means is thus forced upwardly to a second closed position shown in FIGS. 4A and 4B. In this position, sealing means 124 is once again placed in sealing engagement with bore 120 in valve body 110, thus closing valve ports 134 from communication with sampling chamber 62 in sampler 18. Also in this position, operating mandrel means 50 is moved upwardly such that locking dogs 94 are aligned with locking groove 86. In a manner known in the art, locking dogs 92 move radially inwardly to lockingly engage locking groove 86 so that operating mandrel means 50 is locked in the second closed position.

Once tool 10 or 10' is thus closed, packer 20 and packer 32, if any, may be disengaged from the well bore so that tool string 12 and tool 10 or 10' may be retrieved from well bore 16. Once tool 10 or 10' is out of the well bore, the test fluid in sampler 18 may be drained therefrom in a manner disclosed in U.S. patent application Ser. No. 064,285.

It will be seen, therefore, that the above packer perforate, test and sample tool of the present invention is well adapted to carry out the ends and advantages mentioned as well as those inherent therein. While presently preferred embodiments of the invention have been described for the purposes of this disclosure, numerous changes in the arrangement and construction of parts may be made by those skilled in the art. All such changes are encompassed within the scope and spirit of the appended claims.

What is claimed is:

1. A downhole tool for use in a well bore, said tool comprising:

housing means for attaching to a tool string;

packer means for sealingly engaging said well bore such that a well annulus portion is defined above and below said packer means;

sampler means disposed above said packer means for receiving a well fluid sample without flowing well fluids into said tool string; and activator means for providing fluid communication between said sampler means and said well annulus portion below said packer means, said activator means being movable in response to a pressure in said well annulus portion above said packer means.

2. The tool of claim 1 wherein said activator means is movable from a first closed position to an open position and from said open position to a second closed position.

3. The tool of claim 2 further comprising shearing means for shearably holding said activator means in said first closed position.

4. The apparatus of claim 2 further comprising locking means for locking said activator means in said second closed position.

5. The tool of claim 1 wherein:

said packer means is a first packer means; and said tool further comprises a second packer means for sealingly engaging said well bore below said first packer means.

6. The tool of claim 5 wherein said activator means provides communication between said sampler means and a well annulus portion defined between said first and second packer means.

7. The tool of claim 1 further comprising passageway means in said housing means for communicating between said sampler means and a portion of said housing means below said packer means.

8. A downhole tool for testing fluid from a formation reservoir in a well, said tool comprising:

a packer connectable to a drill string and sealingly engageable with a well bore such that a first well annulus portion is defined above the packer and a second well annulus portion is defined therebelow;

a housing portion disposed above said packer and defining a sampling chamber therein, said sampling chamber having no communication with said tool string;

a valve disposed below said packer and having a valve portion therein in communication with said second well annulus portion;

passageway means for providing communication between said sample chamber and said valve; and an operating mandrel slidably disposed in said housing portion, packer and valve for providing fluid communication between said sampling chamber and said port in said valve when in an open position.

9. The tool of claim 8 wherein:

said housing defines an actuator port therein in communication with said first well annulus portion;

said operating mandrel is movable in response to a pressure differential between said first well annulus portion and a pressure in said tool.

10. The tool of claim 8 wherein:

said packer is an upper packer; and further comprising a lower packer spaced below said upper packer and sealing a lower end of said second well annulus portion.

11. The apparatus of claim 10 wherein said valve port is located between said packers.

12. The tool of claim 8 further comprising draining means for draining said sampling chamber when said tool is removed from said well bore.

13. The tool of claim 8 further comprising locking means for locking said operating mandrel against further movement once said valve is reclosed.

14. The tool of claim 8 wherein said operating mandrel comprises an area thereon against which a differential pressure between a central opening of said mandrel and said first well annulus portion acts.

15. The tool of claim 14 wherein said passageway means comprises a passageway defined in said housing portion and extending around said area on said operating mandrel.

16. A method of sampling fluid from a well formation comprising the steps of:

positioning a tool on a tool string in a well bore;

setting a packer in said tool in said well bore such that well annulus portions are defined above and below packer;

actuating a perforating gun below said packer to perforate said formation;

opening a sampler valve below said packer by lowering pressure in said well annulus portion above said packer to a level below a pressure in said tool;

filling a sampling chamber above said packer with a predetermined volume of formation fluid from said well annulus portion below said packer, while keeping said sampling chamber isolated from said tool string;

closing said sampler valve by raising pressure in said well annulus above said packer to a level above a pressure in said tool;

unsetting said packer;

removing said tool string from said well bore; and draining fluid from said sampling chamber.

17. The method of claim 16 further comprising the step of setting a second packer below the first mentioned packer such that said well annulus portion below said first packer is sealed below said well formation.

18. The method of claim 16 comprising the step of locking said sampler valve after closure thereof.

19. The method of claim 16 wherein said steps of opening and closing said sampler valve comprise actuating an operating mandrel which extends above and below said packer in said tool string.

* * * * *

UNITED STATES PATENT AND TRADEMARK OFFICE

CERTIFICATE OF CORRECTION

PATENT NO. : 4,883,123

DATED : November 28, 1989

INVENTOR(S) : Gary D. Zunkel et al

It is certified that error appears in the above-identified patent and that said Letters Patent is hereby corrected as shown below:

In Column 3, Line 61, change the first number "3B" to the number -- 3A --

In Column 10, Line 3, after the word 'below' insert therefore the word -- said --

Signed and Sealed this

Twenty-fifth Day of August, 1992

*Attest:*

DOUGLAS B. COMER

*Attesting Officer*

*Acting Commissioner of Patents and Trademarks*